US008931405B2

(12) United States Patent
Lai

(10) Patent No.: US 8,931,405 B2
(45) Date of Patent: Jan. 13, 2015

(54) REVERSE TENSION MECHANISM FOR A STRAPPING MACHINE

(76) Inventor: Chien-Fa Lai, Taichung (TW)

( * ) Notice: Subject to any disclaimer, the term of this patent is extended or adjusted under 35 U.S.C. 154(b) by 170 days.

(21) Appl. No.: 13/537,149

(22) Filed: Jun. 29, 2012

(65) Prior Publication Data

US 2013/0014654 A1 Jan. 17, 2013

(30) Foreign Application Priority Data

Jul. 13, 2011 (GB) ..... 1111986.4

(51) Int. Cl.
*B65B 13/22* (2006.01)
*B65B 13/06* (2006.01)

(52) U.S. Cl.
CPC ..... *B65B 13/22* (2013.01); *B65B 13/06* (2013.01)
USPC ..... 100/32; 100/26; 100/29

(58) Field of Classification Search
CPC ..... B65B 13/22; B65B 13/06
USPC ..... 100/26, 29, 32; 53/589; 254/213, 216, 254/225, 226; 226/177, 186, 187; 242/418, 242/564.4
See application file for complete search history.

(56) References Cited

U.S. PATENT DOCUMENTS

| | | | | | |
|---|---|---|---|---|---|
| 2,361,470 | A * | 10/1944 | Flood | 53/399 |
| 4,383,881 | A * | 5/1983 | Sakaki | 156/361 |
| 4,559,767 | A * | 12/1985 | Takami | 53/589 |
| 4,912,908 | A * | 4/1990 | Sakaki | 53/589 |
| 5,083,412 | A * | 1/1992 | Sakaki et al. | 53/399 |
| 5,377,477 | A * | 1/1995 | Haberstroh et al. | 53/399 |
| 6,334,563 | B1 * | 1/2002 | Schwede | 226/35 |
| 6,467,243 | B1 * | 10/2002 | Su et al. | 53/589 |
| 7,165,379 | B1 * | 1/2007 | Lai | 53/589 |

* cited by examiner

*Primary Examiner* — Jimmy T Nguyen
*Assistant Examiner* — Leonel Vasquez
(74) *Attorney, Agent, or Firm* — Alan D. Kamrath; Kamrath IP Lawfirm, P.A.

(57) ABSTRACT

A reverse tension mechanism for a strapping machine includes an active wheel, a supporting arm installed with a passive wheel, a lever, and a spring. The supporting arm can be moved relative to the active wheel, so that a strapping band which passes between the passive wheel and the active wheel is clamped to control retracting and tightening of the strapping band. A first end of the lever is pivotably connected to a section of the supporting arm, and the spring is vertically installed between a second end of the lever and the section of the supporting arm. The first end of the lever can be activated by a cam to press the spring vertically to produce a pushing force to swing the supporting arm.

12 Claims, 9 Drawing Sheets

REVERSE TENSION MECHANISM FOR A STRAPPING MACHINE

BACKGROUND OF THE INVENTION

1. Field of the Invention

The present invention relates to a reverse tension mechanism for a strapping machine and, more particularly, to a reverse tension mechanism for retracting and tightening a strapping band for strapping machines.

2. Description of the Related Art

FIGS. 9 to 11 show a conventional strapping machine which includes a forward-reverse assembly 30 and a tension assembly 50. The forward-reverse assembly 30 includes a combination of an active wheel 311 and a passive wheel 312 to perform forwarding and reversing actions of a strapping band 20. The tension assembly 50 includes another combination of an active wheel 511 and a passive wheel 513 to allow the strapping band 20 to extend therebetween and to be tightened. The tension assembly 50 further includes a lever unit 52 having a horizontal rod 53, a tension arm 54, and a driven arm 55. One end of the horizontal rod 53 is pivotably connected to a machine body 10, and the other end of the horizontal rod 53 provided with a rotary member 531 in contact with a cam 42. A spring 56 is installed between the horizontal rod 53 and one end of the tension arm 54. The other end of the tension arm 54 is pivotably connected to one end of the driven arm 55, and the other end of the driven arm 55 is rotatably connected to the machine body 10. Further, the passive wheel 513 is pivotably connected to the driven aim 55 and adjacent to the active wheel 511. The horizontal rod 53 can be actuated by the cam 42, so that the passive wheel 513 is moved to change a position relative to the active wheel 511 when the horizontal rod 53 swings. Accordingly, the tightening force exerted on the strapping band 20 by the active wheel 511 and the passive wheel 513 can be controlled. However, the lever unit 52 composed of the horizontal rod 53, the tension arm 54, and the driven arm 55 occupies a large space horizontally. Thus, both the cost and size of the conventional strapping machine are increased. Furthermore, since the spring 56 is disposed adjacent to the rotary member 531 of the horizontal rod 53, the compressed displacement of the spring 56 is small when the cam 42 activates the horizontal rod 53 to swing (see FIG. 11). Thus, a pushing force transmitted to the tension arm 54 from the wiggling motion of the horizontal rod 53 is weak, and the weak pushing force further transmitted to the passive wheel 513 and the active wheel 511 is incapable for clamping the strapping band 20 tightly. The strapping band 20 will easily slip off from an object which needs strapping.

BRIEF SUMMARY OF THE INVENTION

Thus, it is an objective of the present invention to overcome the aforementioned shortcoming and deficiency of the prior art by providing a reverse tension mechanism for a strapping machine. The reverse tension mechanism can be used for retracting and tightening a strapping band and has the advantages of a simple structure, being compact in size to save space horizontally, and enhancing the tightening effect of the strapping band.

To achieve the foregoing objective, a reverse tension mechanism for a strapping machine of the present invention includes an active wheel, a supporting arm, a passive wheel, a lever, and a spring. The active wheel is rotatably mounted on a machine body of the strapping machine and includes a clamping portion. The machine body has a camshaft and a cam installed on the camshaft. The supporting arm includes first and second sections spaced in a horizontal direction. The first section of the supporting arm is pivotably connected to the machine body so that the supporting arm is pivotable relative to the active wheel. The supporting arm further includes inner and outer surfaces opposite in a thickness direction perpendicular to the horizontal direction and upper and lower ends spaced in a vertical direction perpendicular to the horizontal and thickness directions. An opening is defined in the second section of the supporting arm. A spring seat is formed on the outer surface of the second section of the supporting arm. The passive wheel is rotatably mounted on the inner surface of the first section of the supporting arm and meshes with the active wheel. The passive wheel includes a clamping portion, and a gap is formed between the clamping portion of the passive wheel and the clamping portion of the active wheel for a strapping band to pass through. The lever extends through the opening of the second section of the supporting arm and includes first and second ends spaced in the thickness direction. The first end of the lever has an abutting member abutting against the cam and has a pivot hole disposed between the abutting member and the second end of the lever. A pivot extends through the second section of the supporting arm and the pivot hole of the lever, so that the lever is pivotably connected to the second section of the supporting arm and swings about an axis defined by the pivot when the cam turns. The second end of the lever is disposed above the spring seat. The spring is installed between the second end of the lever and the spring seat of the supporting arm in the vertical direction. The spring is compressed in the vertical direction to produce a pushing force to move the supporting arm and the passive wheel when the lever swings.

In a preferred form, an inverted L-shaped supporting portion extends upward from the upper end of the second section of the supporting arm, such that the opening is defined between the L-shaped supporting portion and the upper end of the second section of supporting arm. A connecting portion extends outwards from the inner surface of the supporting portion and has a shaft hole. The first end of the lever includes two aligned pivot holes, and the pivot extends through the shaft hole of the supporting portion of the supporting arm and the two pivot holes. Further, an adjusting screw extends through a top end of the supporting portion for adjusting the gap between the passive wheel and the active wheel.

Preferably, the second section of the lever includes an engaging hole extending through the second section of the lever in the vertical direction, and a spring cover is received and swings freely in the engaging hole. The spring includes a bottom end pressed against the spring seat and an upper end received inside a bottom of the spring cover.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

DETAILED DESCRIPTION OF THE INVENTION

Figure 1:
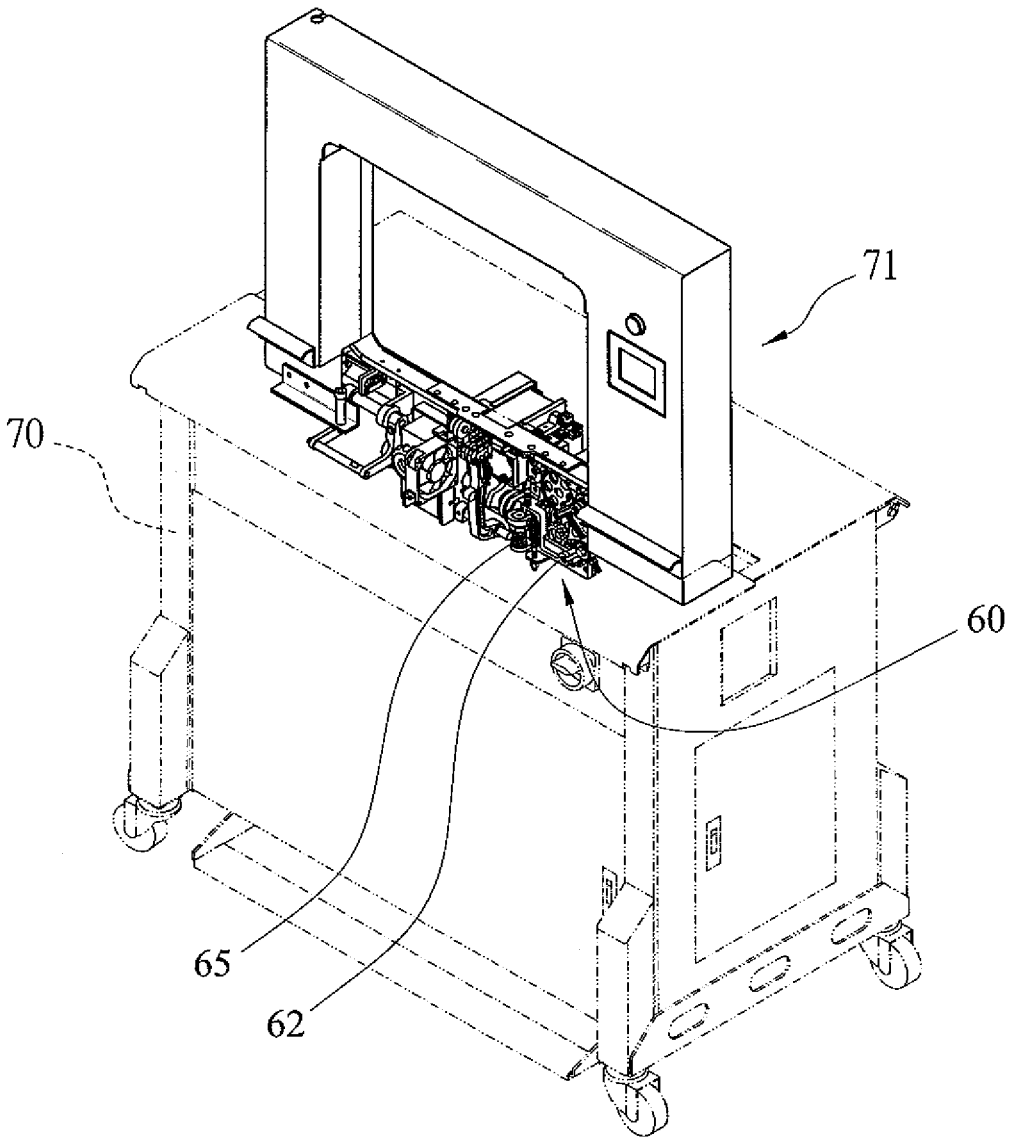
FIG. 1 shows a diagrammatic, perspective view of a strapping machine utilizing a reverse tension mechanism according to the preferred teachings of the present invention.
Figure 2:
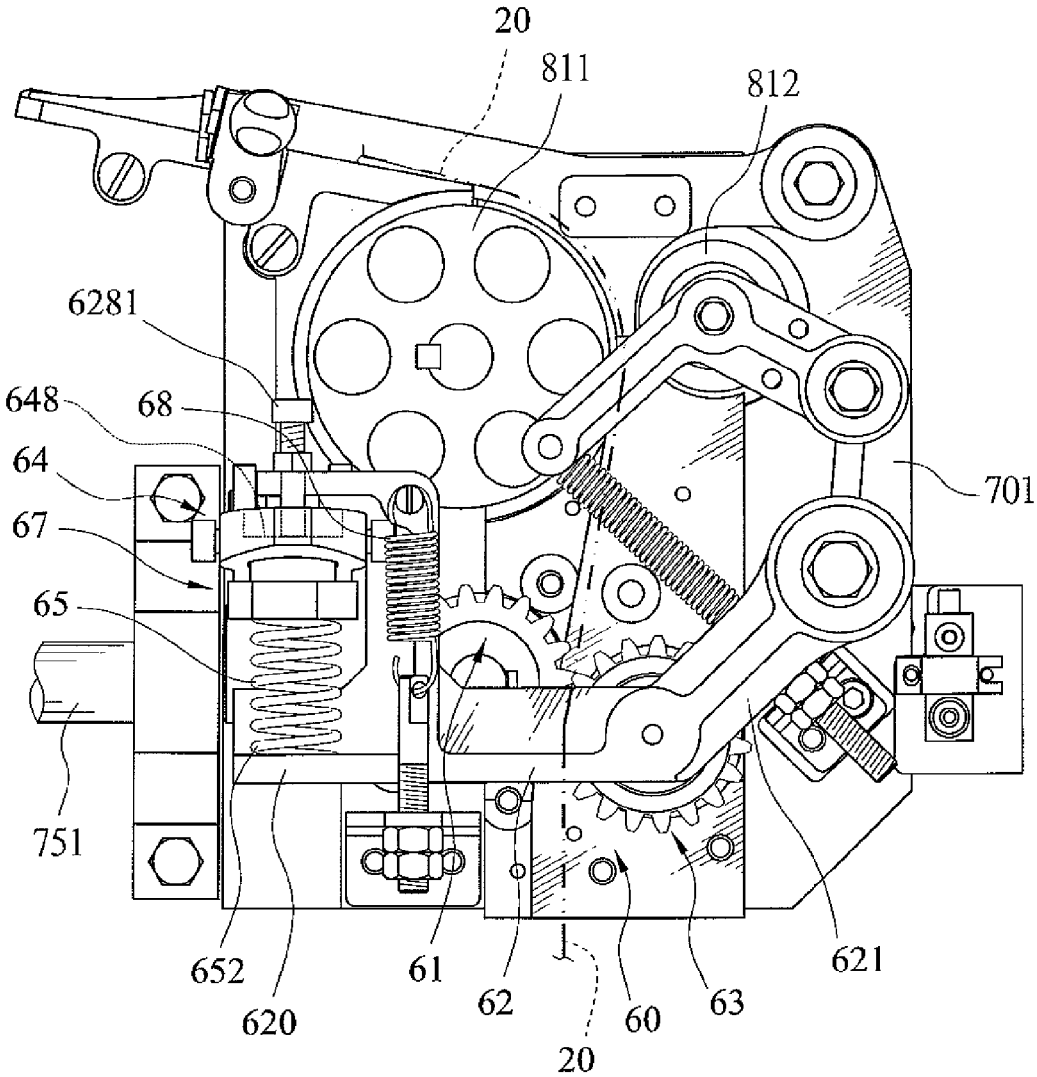
FIG. 2 shows a front plan view of the reverse tension mechanism of FIG. 1.
Figure 3:
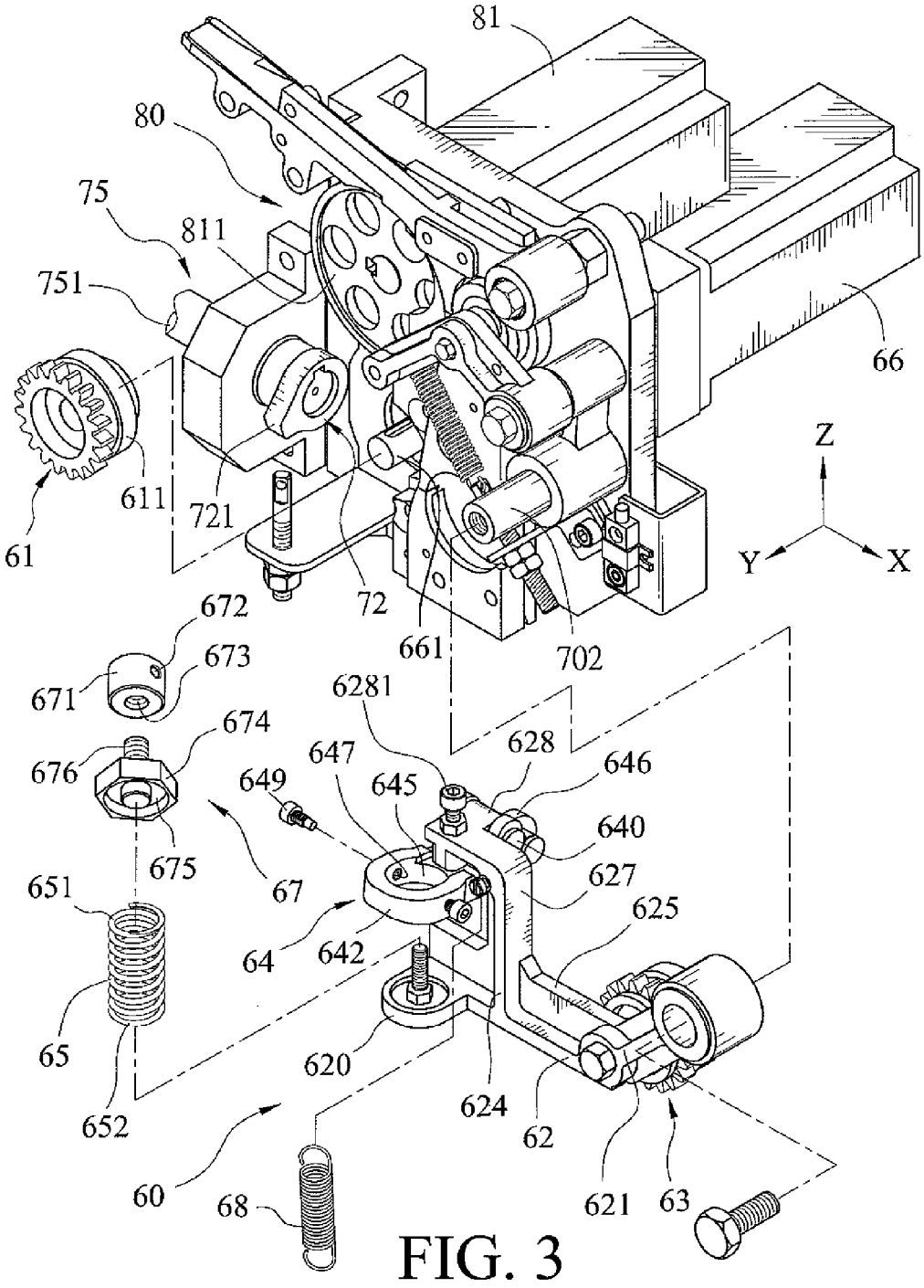
FIG. 3 shows an exploded, perspective view of the reverse tension mechanism of FIG. 2.

A reverse tension mechanism for a strapping machine according to the preferred teachings of the present invention is shown in FIGS. 1 through 8 of the drawings and generally designated 60. The reverse tension mechanism 60 is mounted on a machine body 70 of the strapping machine. A guide arch frame 71 is mounted on a top of the machine body 70. A transmission assembly 75, a band feeding assembly 80, a guide wheel unit, a band reel mechanism, and a band storage device are mounted to the machine body 70. The guide wheel unit, the band reel mechanism, and the storage device are conventional. In this embodiment, the transmission assembly 75 includes a camshaft 751 and a cam 72 installed on the camshaft 751 and having a protrusion 721 on an outer periphery of the cam 72 (see FIG. 3). The band feeding assembly 80 includes an active wheel 811, a passive wheel 812, and a motor 81 for driving the active wheel 811. The constructions and actions of the machine body 70, the arch frame 71, the band feeding assembly 80, the guide wheel unit, the band reel mechanism, and the band storage device are not specifically mentioned in this description because they are not what the present invention aims for.

In general, a strapping band 20 is fed forward from the band reel mechanism to the reverse tension mechanism 60 via the guide wheel unit. Then, the strapping band 20 goes between the active wheel 811 and the passive wheel 812 of the band feeding assembly 80 to enter into the arch frame 71. The strapping band 20 is fed forward by the clockwise turning of the active wheel 811 and is retracted by the counterclockwise turning of the active wheel 811, so that the strapping band 20 can be strapped around an object. The tightening action of the strapping band 20 is carried out by the reverse tension mechanism 60 of the present invention. When the strapping band 20 strapped on the object is tightened, it can be fused and cut off to finish the strapping process.

Figure 4:
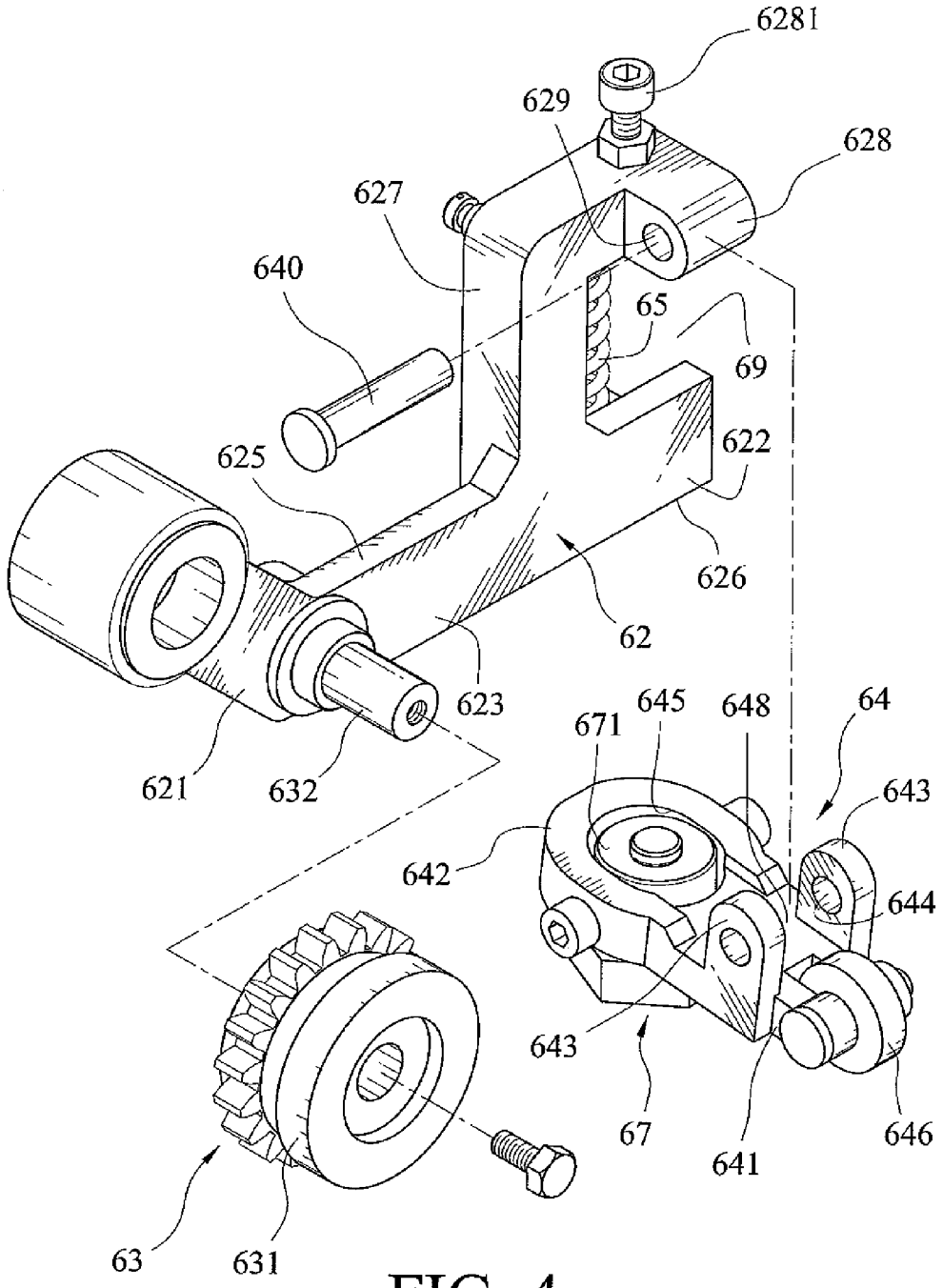
FIG. 4 shows a partial, exploded, perspective view of the reverse tension mechanism of FIG. 3.
Figure 5:
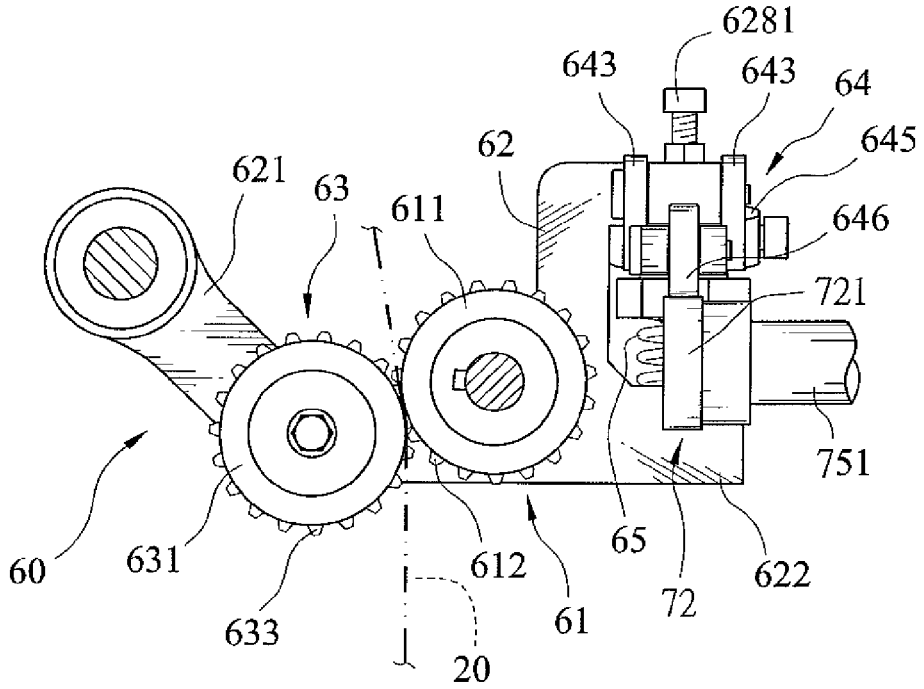
FIG. 5 is a plan view showing a strapping band extending between an active wheel and a passive wheel of the reverse tension mechanism of FIG. 2.
Figure 6:
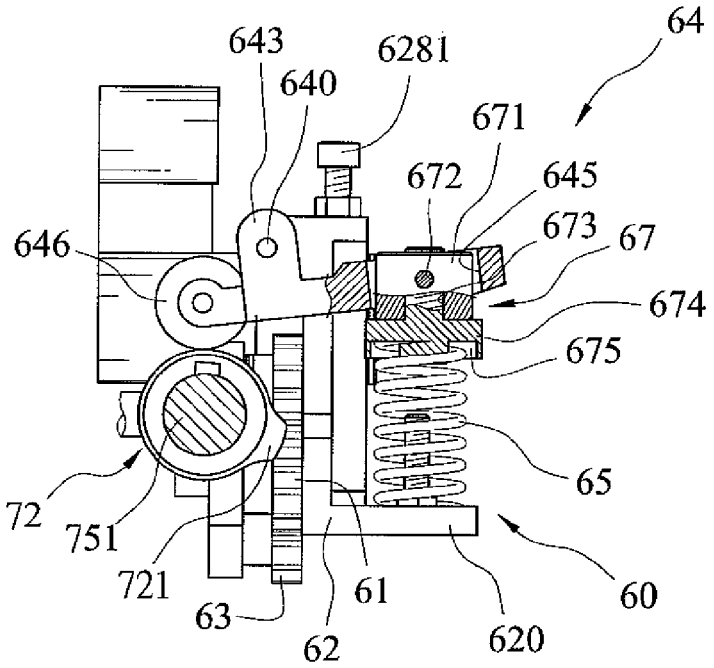
FIG. 6 is a side view of the reverse tension mechanism of FIG. 5.
Figure 7:
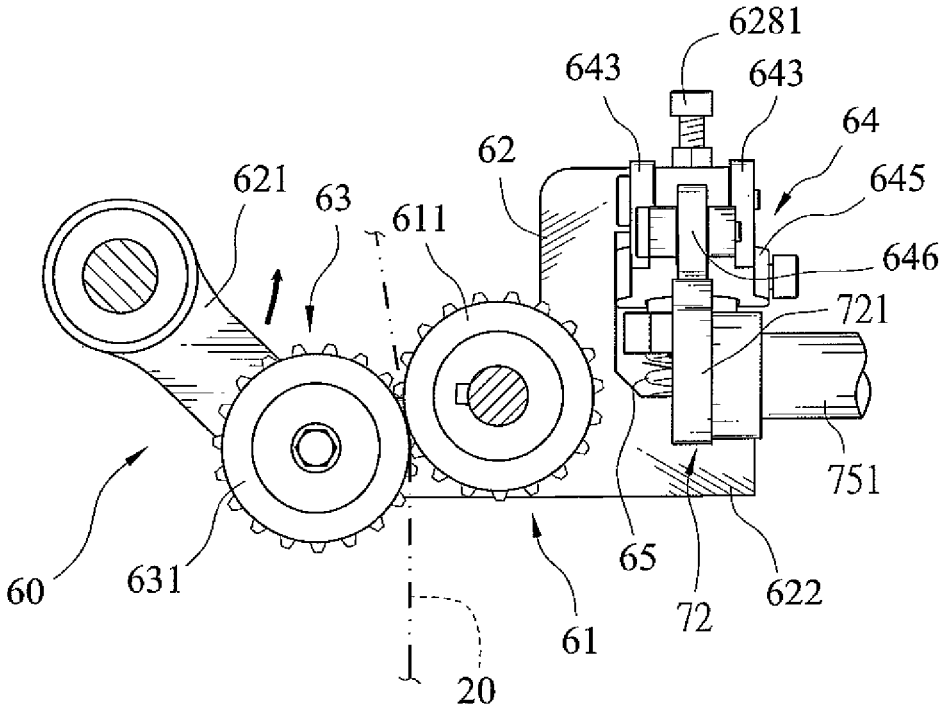
FIG. 7 is a plan view similar to FIG. 5 showing the passive wheel moved to a position to tighten the strapping band.
Figure 8:
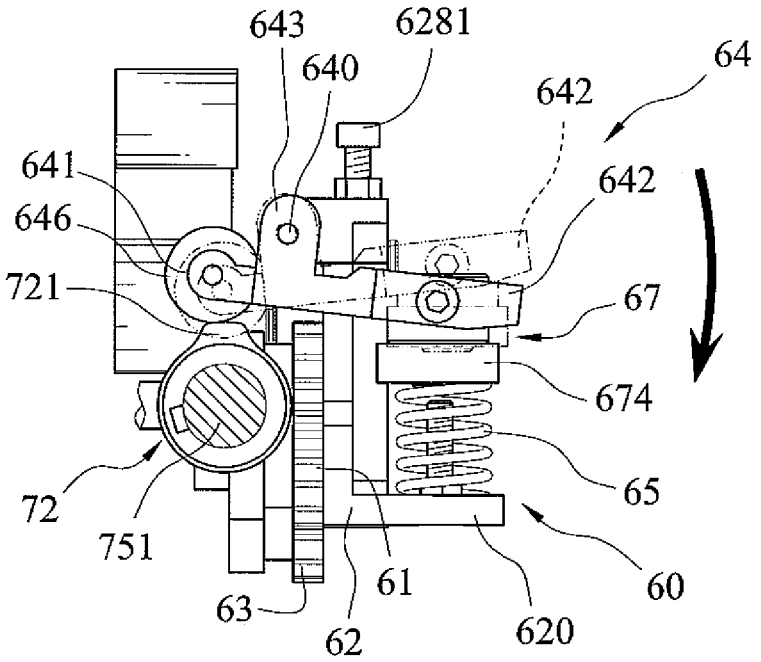
FIG. 8 is a plan view similar to FIG. 6 showing a wiggling motion of a lever of the reverse tension mechanism of FIG. 6 with a spring of the reverse tension mechanism compressed.
Figure 9:
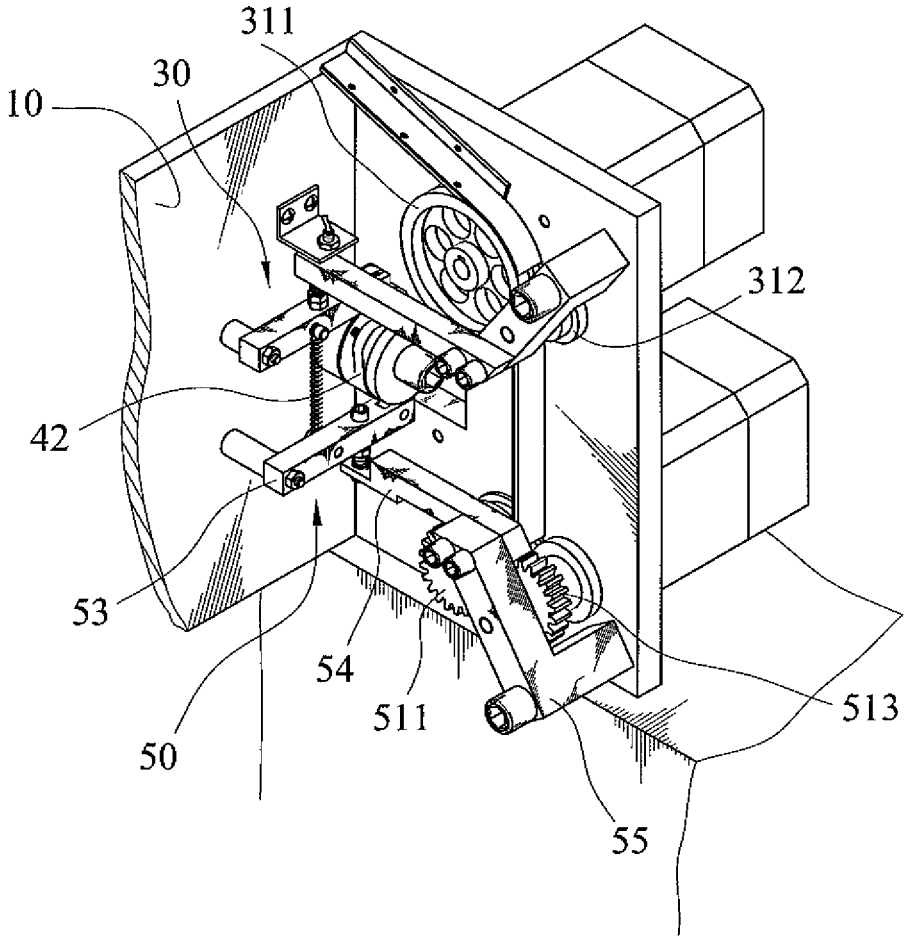
FIG. 9 (Prior Art)
FIG. 9 is a partial, perspective view of a conventional strapping machine.
Figure 10:
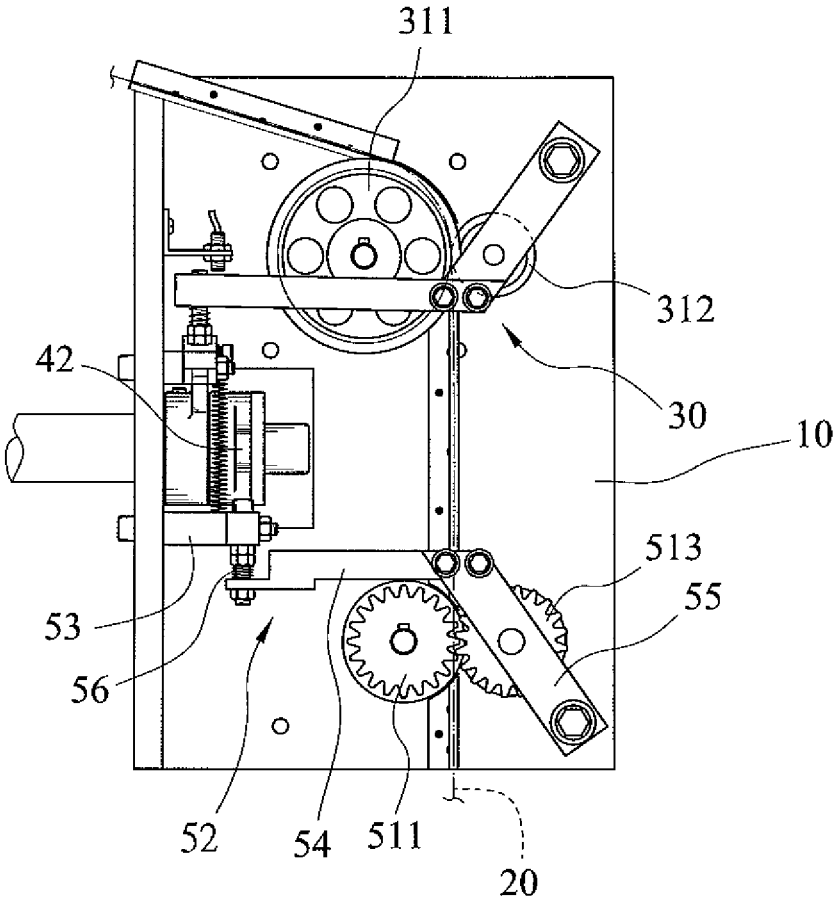
FIG. 10 (Prior Art)
FIG. 10 is a plan view of the conventional strapping machine of FIG. 9.
Figure 11:
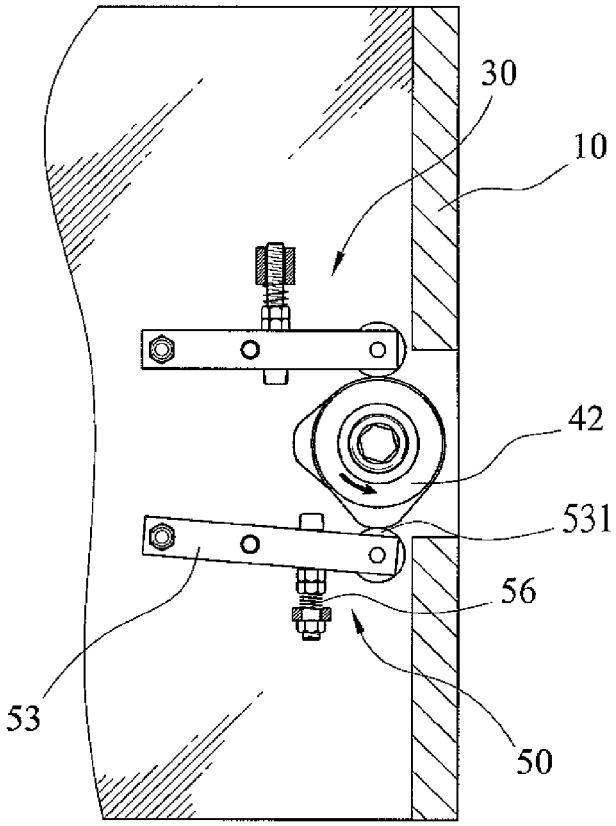
FIG. 11 (Prior Art)
FIG. 11 is a diagrammatic view showing a cam of FIG. 10 rotated to move a horizontal rod of the conventional strapping machine.

The reverse tension mechanism 60 includes an active wheel 61, a supporting arm 62, a passive wheel 63, a lever 64, and a spring 65. The active wheel 61 is mounted on an output shaft 661 of a motor 66 (see FIG. 3). The motor 66 is installed on a wall 701 of the machine body 70. In this embodiment, one end of the active wheel 61 is a gear 612 and another end of the active wheel 61 is a clamping portion 611. The supporting arm 62 extends in a horizontal direction (X) and includes first and second sections 621 and 622 spaced in the horizontal direction. The first section 621 of the supporting arm 62 is pivotably connected to a pivot 702 mounted to the wall $\mathbf{701}_3$ so that the supporting arm 62 is pivotable about an axis defined by the pivot 702. The supporting arm 62 further includes inner and outer surfaces 623 and 624 opposite in a thickness direction (Y) and upper and lower ends 625 and 626 spaced in a vertical direction (Z) perpendicular to the horizontal and thickness directions. The inner surface 623 of the supporting arm 62 faces the active wheel 61. An inverted L-shaped supporting portion 627 extends upward from the upper end 625 of the second section 622 of the supporting arm 62, such that an opening 69 is defined between the supporting portion 627 and the upper end 625 of the second section 622 of supporting arm 62 (FIG. 4). A connecting portion 628 having a shaft hole 629 extends outwards from the inner surface 623 of the supporting portion 627. An adjusting screw 6281 extends through a top end of the supporting portion 627. A spring seat 620 extends outward from the outer surface 624 of the second section 622 of the supporting arm 62 (see FIG. 3). A return spring 68 is mounted between the supporting arm 62 and the band feeding assembly 80.

The passive wheel 63 is rotatably installed on a shaft 632 mounted to the inner surface 623 of the first section 621 of the supporting arm 62 (see FIG. 4). One end of the passive wheel 63 is a gear 633 and another end is a clamping portion 633. The gear 633 of the passive wheel 63 is meshed with the gear 612 of the active wheel 61, and the strapping band 20 passes through a gap defined between the clamping portion 631 of the passive wheel 63 and the clamping portion 611 of the active wheel 61. Furthermore, the wiggling motion of the supporting arm 62 displaces the passive wheel 63, so that the clamping portion 631 of the passive wheel 63 is movable relative to the clamping portion 611 of the active wheel 61. When the clamping portion 631 of the passive wheel 63 is moved to be closer to the clamping portion 611 of the active wheel 61, the strapping band 20 will be clamped tightly between the passive wheel 63 and the active wheel 61. The intensity of the clamping force can be used to control the reverse or tension action of the strapping band 20.

The lever 64 extends through the opening 69 of the second section 622 of the supporting arm 62 in the thickness direction (Y) and includes first and second ends 641 and 642 spaced in the thickness direction. The first end 641 of the lever 64 is provided with an abutting member 646 which is a bearing in this embodiment to get in contact with the cam 72 of the transmission assembly 75 (see FIG. 6). Further, a lug 643 extends upward from each side of the first end 641 of the lever 64 and is disposed between the abutting member 646 and the second end 642 of the lever 64. The lugs 643 include aligned pivot holes 644. A pivot 640 extends through the shaft hole 629 of the supporting portion 627 of the supporting arm 62 and the two pivot holes 644, so that the first end 641 of the lever 64 is pivotably connected to the second section 622 of the supporting arm 62. Accordingly, the lever 64 can swing about an axis defined by the pivot 640 when the cam 72 turns. The inner end of the adjusting screw 6281 is pressed against an upper surface 648 of the lever 64 (see FIG. 2), so that the gap between the passive wheel 63 and the active wheel 61 can be changed by turning the adjusting screw 6281, allowing the strapping band 20 with suitable thickness to be extended through the gap smoothly. Furthermore, the second end 642 of the lever 64 is disposed above the spring seat 620 and includes an engaging hole 645 extending through the second section end 642 in the vertical direction (Z) and two screw holes 647 in communication with the engaging hole 645. A spring cover 67 is received in the engaging hole 645 and includes a screw sleeve 671 and a pressing screw 674. The pressing screw 674 includes a screw portion 676 which is screwed in a screw hole 673 of the screw sleeve 671. Two bolts 649 respectively extend through the two screw holes 647 of the lever 64 into two pivot holes 672 of the screw sleeve 671, so that the spring cover 67 can swing freely in the engaging hole 645 (a diameter of the pivot hole 672 is greater than an outer diameter of a front end of the bolt 649). A lower end 652 of the spring 65 is pressed against the spring seat 620, and an upper end 651 of the spring 65 is received in a bottom encasement 675 of the pressing screw 674. When the pressing screw 674 is turned to change a position of the bottom encasement 675 relative to the screw sleeve 671, the spring 65 will be pressed to produce a prestressed force.

According to the description mentioned above, the reverse tension mechanism 60 can be employed to retract and tighten the strapping band 20 for strapping an object. More specifically, contacting portions of the cam 72 with the abutting member 646 of the lever 64 are changed from the basic circular portion of the cam 72 to the protrusion 721. When the protrusion 721 of the cam 72 is in contact with the abutting member 646 of the lever 64, the lever 64 will be moved in different extents according to the profile of the protrusion 721. The wiggling extent of the lever 64 is smaller in the initial section of the protrusion 721 of the cam 72. Further, when the protrusion 721 of the earn 72 is in contact with the abutting member 646 of the lever 64, the wiggling motion of the lever 64 presses the spring 65 to make the supporting arm 62 to swing with the lever 64 (see FIGS. 7 and 8). Thus, the passive wheel 63 is closer to and pressed against the active wheel 61 more tightly, and, therefor; the strapping band 20 will be clamped tightly (when prestressed force is produced by turning the pressing screw 674, the pressure exerted on the strapping band 20 is the prestressed force plus the compression force from the spring 65). At the same time, the motor 66 is rotated counterclockwise to activate the active wheel 61 to retract and tighten the strapping band 20. Thus, the strapping band 20 can be strapped tightly around the object. Finally, the strapping band 20 can be fused and cut off to finish the strapping process.

The reverse tension mechanism 60 of the present invention has the advantages of a simple structure, being compact in size to save space horizontally, and enhancing the tighten effect of strapping bands. More specifically, the reverse tension mechanism 60 only includes the active wheel 61, the supporting arm 62 installed with the passive wheel 63, the lever 64, and the spring 65. Furthermore, the lever 64, the supporting arm 62, and the spring 65 are arranged in the horizontal, thickness, and vertical directions perpendicular to one another and, thus, only occupy small spaces. Further, the distance between the second end 642 of the lever 64 and the pivot 640 is greater than the distance between the first end 641 of the lever 64 and the pivot 640 (see FIG. 8), so that the spring 65 is pressed to produce a larger displacement when the lever 64 swings. Due to the direct ratio of the resilient force exerted on the supporting arm 62 by the spring 65 and the compressed displacement of the spring 65, the pushing force transmitted to the supporting arm 62 from the wiggling motion of the lever 64 is strong enough, so that the pressing force of the passive wheel 63 against the active wheel 61 can clamp the strapping band 20 tightly, enhancing the tightening effect of the strapping band 20 for strapping the object. Further, the spring cover 67 which presses the spring 65 can swing freely in the engaging hole 645, so that the spring 65 is moved vertically without inclining when the lever 64 swings.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A strapping machine comprising:

a machine body having a camshaft and a cam installed on the camshaft; and a reverse tension mechanism comprising:

an active wheel rotatably mounted on the machine body and including a clamping portion;

a supporting arm including first and second sections spaced in a horizontal direction, with the first section of the supporting aim pivotably connected to the machine body, wherein the supporting arm is pivotable relative to the active wheel, with the supporting arm further including inner and outer surfaces spaced in a thickness direction perpendicular to the horizontal direction, with the second section of the supporting arm including upper and lower ends spaced in a vertical direction perpendicular to the horizontal and thickness directions, with an opening defined between the upper end and the lower end of the second section of the supporting arm, with a spring seat formed on the outer surface of the second section of the supporting arm;

a passive wheel rotatably mounted on the inner surface of the first section of the supporting arm and rotatable with the active wheel, with the passive wheel including a clamping portion, with a gap formed between the clamping portion of the passive wheel and the clamping portion of the active wheel for a strapping band to pass through;

a lever extending through the opening of the second section of the supporting arm and including first and second ends spaced in the thickness direction, with the first end of the lever having an abutting member abutting against the cam, with the lever having at least one pivot hole disposed between the abutting member and the second end of the lever, with a pivot extending through the second section of the supporting arm and the pivot hole of the lever, wherein the lever is pivotably connected to the second section of the supporting arm and swings about an axis defined by the pivot when the cam turns, with the second end of the lever disposed above the spring seat; and a spring installed between the second end of the lever and the spring seat of the supporting arm in the vertical direction, with the spring compressed in the vertical direction to produce a pushing force to move the supporting arm and the passive wheel when the lever swings.

2. The strapping machine according to claim 1, with the second section of the supporting arm including an inverted L-shaped supporting portion defining the opening in the second section of the supporting arm, with a connecting portion extending outwards from the inner surface of the supporting portion and having a shaft hole, with the lever including another pivot hole aligned with the pivot hole, and with the pivot extending through the shaft hole of the supporting portion of the supporting arm and the aligned pivot holes.

3. The strapping machine according to claim 2, with an adjusting screw extending through a top end of the supporting portion and adjusting the gap between the passive wheel and the active wheel.

4. The strapping machine according to claim 1, with the second end of the lever including an engaging hole extending through the second end of the lever in the vertical direction, with a spring cover received and swinging freely in the engaging hole, and with the spring including a lower end pressed against the spring seat and an upper end received inside a bottom of the spring cover.

5. The strapping machine according to claim 4, with the spring cover including a screw sleeve and a pressing screw, with the pressing screw including a screw portion screwed in a screw hole of the screw sleeve, with two bolts respectively extending through two screw holes of the lever into two pivot holes of the screw sleeve with the spring cover swinging freely in the engaging hole.

6. The strapping machine according to claim 5, with an adjusting screw extending through a top end of the supporting portion and adjusting the gap between the passive wheel and the active wheel.

7. The strapping machine according to claim 1, wherein the active wheel includes a first gear; wherein the passive wheel includes a second gear, with the first and second gears meshing together to rotatably relate the active and passive wheels.

8. The strapping machine according to claim 7, with the second section of the supporting arm including an inverted L-shaped supporting portion defining the opening in the second section of the supporting arm, with a connecting portion extending outwards from the inner surface of the supporting portion and having a shaft hole, with the lever including another pivot hole aligned with the pivot hole, and with the pivot extending through the shaft hole of the supporting portion of the supporting arm and the aligned pivot holes.

9. The strapping machine according to claim 8, with an adjusting screw extending through a top end of the supporting portion and adjusting the gap between the passive wheel and the active wheel.

10. The strapping machine according to claim 7, with the second end of the lever including an engaging hole extending through the second end of the lever in the vertical direction, with a spring cover received and swinging freely in the engaging hole, and with the spring including a lower end pressed against the spring seat and an upper end received inside a bottom of the spring cover.

11. The strapping machine according to claim 10, with the spring cover including a screw sleeve and a pressing screw, with the pressing screw including a screw portion screwed in a screw hole of the screw sleeve, with two bolts respectively extending through two screw holes of the lever into two pivot holes of the screw sleeve with the spring cover swinging freely in the engaging hole.

12. The strapping machine according to claim 11, with an adjusting screw extending through a top end of the supporting portion and adjusting the gap between the passive wheel and the active wheel.

* * * * *